US006209873B1

(12) United States Patent
DeGeorge

(10) Patent No.: US 6,209,873 B1
(45) Date of Patent: Apr. 3, 2001

(54) ROLE AND WAR GAME PLAYING SYSTEM

(76) Inventor: Andrew DeGeorge, 17 Westover Ave. B-19, Caldwell, NJ (US) 07006

( * ) Notice: Subject to any disclaimer, the term of this patent is extended or adjusted under 35 U.S.C. 154(b) by 0 days.

(21) Appl. No.: 09/442,972

(22) Filed: Nov. 18, 1999

(51) Int. Cl.[7] ..... A63F 3/02
(52) U.S. Cl. ..... 273/262; 273/265
(58) Field of Search ..... 273/262, 265, 273/255, 258, 236

(56) References Cited

U.S. PATENT DOCUMENTS

| | | | | |
|---|---|---|---|---|
| 186,181 | | 1/1877 | Underwood . | |
| 3,048,404 | | 8/1962 | Tebbs . | |
| 3,353,829 | * | 11/1967 | Board . | |
| 3,401,936 | * | 9/1968 | Greenberg . | |
| 3,565,436 | * | 2/1971 | Opmeer . | |
| 3,998,463 | | 12/1976 | Zumchak | 273/131 |
| 4,059,275 | * | 11/1977 | Price . | |
| 4,221,389 | | 9/1980 | Read | 273/262 |
| 4,280,704 | * | 7/1981 | Massimei . | |
| 4,765,627 | * | 8/1988 | Ross . | |
| 4,982,965 | | 1/1991 | Dozorsky | 273/262 |
| 5,026,070 | | 6/1991 | Watt | 273/261 |
| 5,163,688 | | 11/1992 | Simms | 273/298 |
| 5,171,018 | * | 12/1992 | Zhang . | |
| 5,251,905 | * | 10/1993 | Bombino . | |
| 5,388,837 | | 2/1995 | Hoffman | 273/262 |
| 5,401,031 | * | 3/1995 | Kuna . | |
| 5,662,332 | | 9/1997 | Garfield | 273/308 |

OTHER PUBLICATIONS

Robert Markham, *Four Battles of the American Civil War,* From *The Seven Days Battles* pp. 1–16.
Steve Jackson Games, Inc., *An Introduction to Roleplaying,* Gurps Lite Jun. 1999 pp. 1–32.
Jim Lee et al., C*23—*An ARC System Game,* pp. 1–11 (1998), distributed by Wizards of the Coast, Inc., http://www.wizards.com/arc_system/C23_Rules.asp.
*Deadlands: The Great Rail Wars* pp. 26–32 (1997), distributed by Pinnacle Entertainment Group, Inc.
*Warzone—Introduction to Table Top Gaming, Mutant Chronicles* pp. 1–16 (1996), distributed by Target Games.

* cited by examiner

*Primary Examiner*—Benjamin H. Layno
*Assistant Examiner*—V K Mendiratta
(74) *Attorney, Agent, or Firm*—Ernest D. Buff & Associates; Ernest D. Buff

(57) ABSTRACT

Combat is resolved and war game play is expanded without the use of dice or the like. Players substantially simultaneously memorialize actions appointed to be taken, and present the actions in a recorded format wherein tactical decisions, not random number generation, become the driving force. The internal logic of hobby war and role playing games is expanded by giving the players of those games the ability to add previously unspecified tactics and actions. The nature of a hobby war game is modified in that the most important element affecting game outcome is a set of decisions made by a player at every engagement.

1 Claim, 4 Drawing Sheets

Fig. 2

| ATTACK STRATEGY \ DEFENSE STRATEGY | Meet Attack | Stand Firm | Strengthen Left Flank | Strengthen Right Flank | Concentrate Center | Defense in Depth | Disperse Defenders | Tactical Withdrawal |
|---|---|---|---|---|---|---|---|---|
| Charge Forward | 2 | 2 | 1 | 1 | 4 | 2 | 2 | 0 |
| Slow Advance | 2 | 4 | 1 | 1 | 3 | 2 | 2 | 2 |
| Flanking Attack Left | 3 | 2 | 1 | 4 | 2 | 1 | 2 | 2 |
| Flanking Attack Right | 3 | 2 | 4 | 1 | 2 | 1 | 2 | 2 |
| Stationary | 4 | 2 | 2 | 2 | 3 | 4 | 2 | 4 |
| Infiltration | 4 | 3 | 2 | 2 | 1 | 0 | 2 | 4 |
| Encirclement | 3 | 3 | 2 | 2 | 1 | 1 | 3 | 4 |
| Attack from Cover | 2 | 2 | 1 | 1 | 2 | 2 | 2 | 3 |

Fig. 3

GAME SHEET circle one: ATTACKER, DEFENDER

Game: WW II Scenario: hedgerow

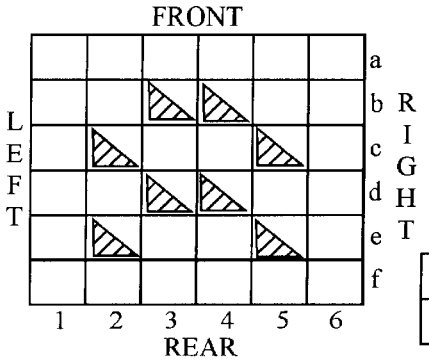

Command Issuing Phase

Attacker: Andrew
2nd panzer

Defender: Ernie
101 Airborne

Tactics:

| Attacker | Defender |
|---|---|
| stationary | defense indepth |

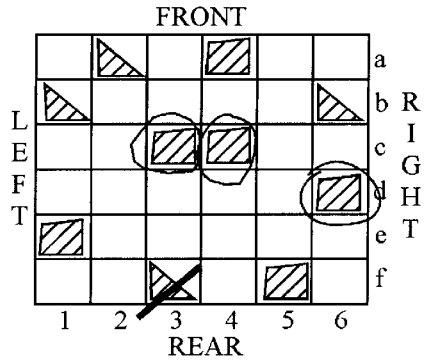

Combat Resolution Phase

Attack Strength 12
Defense Strength 6
Ratio 2:1
Attack Markers 10
Defense Markers 10(4 shields)
Strikes Registered 3
Counter Strikes Registered -1
Summation 2

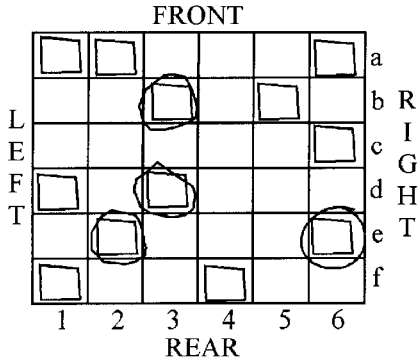

Damage Resolution Phase

Armor / Toughness .4

Markers 12

Scores Registered 4

Engagement Results
1 inflicted
10 causalities

Fig. 4

GAME SHEET circle one: ATTACKER DEFENDER

Game: WW II Scenario: hedgerow

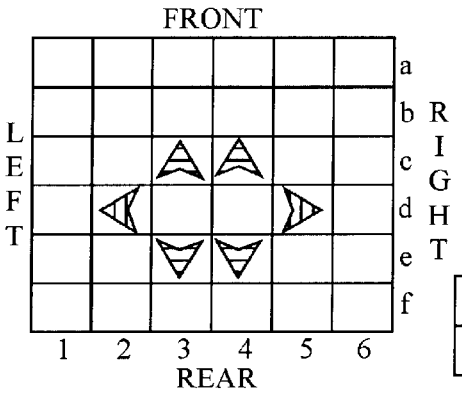

Command Issuing Phase

Attacker: Andrew
2nd panzer

Defender: Ernie
101 Airborne

Tactics:

| Attacker | Defender |
|---|---|
| stationary | defense indepth |

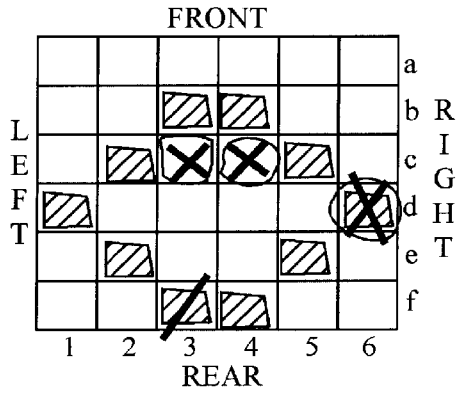

Combat Resolution Phase

Attack Strength 12
Defense Strength 6
Ratio 2:1
Attack Markers 10
Defense Markers 10(4 shields)
Strikes Registered 3
Counter Strikes Registered -1
Summation 2

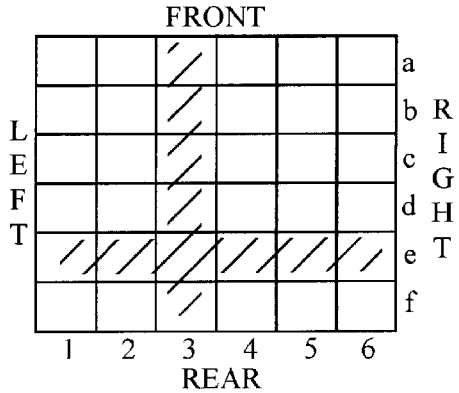

Damage Resolution Phase

Armor / Toughness .4

Markers 12

Scores Registered 4

Engagement Results
1 inflicted
10 causalities

ROLE AND WAR GAME PLAYING SYSTEM

BACKGROUND OF THE INVENTION

1. Field of the Invention

The present invention relates to a war game playing apparatus and method; and more specifically to a method for combat resolution that eliminates the need to generate random numbers, and expands game play by giving players greater control over the actions of the pieces, characters or units that comprise the game. The invention works with most military strategy games by replacing the chance mechanism of the game.

2. Description of the Prior Art

U.S. Pat. No. 186,181 to Underwood discloses a game apparatus consisting of a board representing military engagement, and miniature soldiers having comparative value which determines the number of squares that the pieces can move on the board. Any piece has the power to "take" another one of the pieces coming within the range of its moves.

U.S. Pat. No. 3,048,404 to Tebbs discloses a game specifically directed to aeronautical strategy. The game consists of a game board and pieces not limited to direct or diagonal movements. That is to say, turning movements can be used so that the heading of the aircraft indica on a piece may be changed. Such movements are said to afford a degree or realism in both maneuvering and strategy which is unobtainable in other games. Playing pieces are octagonal in shape so that aircraft heading indica may be changed in intervals of 45° relative to the space occupied thereby.

U.S. Pat. No. 3,998,463 to Zumchak discloses a naval combat game consisting of a plurality of squares and tabs defining the open sea in the Eastern and Western hemispheres, coastal waters and respective seaports. There are also provided games pieces representing naval vessels and their particular characteristics, ocean seaports and naval air bases, all of which cooperate to provide a game of skill.

U.S. Pat. No. 4,221,389 to Read discloses a war game apparatus representing a battlefield. The apparatus consists of a plurality of interchangeable weapon pieces, each of which has an identification to represent a range of a particular weapon. The identification of the weapon corresponds to a particular board space in such a location as to be easily hidden from an opponent. This construction and arrangement of the board and pieces is said to represent more closely a true battlefield situation.

U.S. Pat. No. 4,982,965 to Dozorsky discloses a strategic military type board game consisting of a method wherein there is provided a rectangular board game of 126 checkered squares, and a plurality of pieces for each one of the two players, the pieces arranged at opposed sides of the board in such a manner that a "Capital" piece does not move and must be captured by the opposing side in order for the game to be won.

U.S. Pat. No. 5,026,070 to Watt discloses a strategy board game for naval battles consisting of a game board playing surface. A plurality of playing pieces represent naval vessels having a post extending therefrom. First and second visually distinguishable cylindrical rings indicate vessel power and vessel damage. The rings are stacked on the posts to provide the visual characteristics of the vessel.

U.S. Pat. No. 5,388,837 to Hoffman discloses a game of military strategy that combines elements of skill and chance. A selector dial attached to each playing piece indicates status power of the piece. Games pieces of higher status power have the potential ability to kill, capture or wound a game piece of lesser status power. The selector dial is a movable circular disc divided into six segments corresponding to possible throws of dice. Status power of the playing piece is determined by the selector based on random number generation.

The conventional play for games currently available requires each player to take turns being the aggressor. When one player is taking aggressive action, the opposing player normally takes little or not action, as per scribed by the game rules. None of the conventional hobby war games permit both the attacking and defending players to perform turns substantially simultaneously. Nor do conventional hobby war games provide a procedures for combat resolution and expanding war game play without use of dice or other random number generators.

SUMMARY OF THE INVENTION

The present invention virtually eliminates the need to generate random numbers. Game play is expanded by providing hobby war game players greater control over the actions of the pieces, characters or units that comprise the game. The game provides a means for players to substantially simultaneously memorialize actions appointed to be taken, and present the actions in a recorded format wherein tactical decisions, not random number generation, become the driving force. In a preferred embodiment, there is provided, a means for expanding the internal logic of hobby war and role playing games by giving the players of those games the ability to add previously unspecified tactics and actions. The invention changes the nature of a hobby war game in that the most important element affecting game outcome is a set of decisions made by a player at every engagement.

In one aspect of the invention, there is provided a method for defining a strategy, tactic or action of a game piece, character or unit. The strategy is defined by an arrangement of multiple graphical elements or markers. The graphical elements provide a player with options for creating strategies, tactics or actions to address a plurality of situations or scenarios.

In practice, the method of the invention is accomplished by simultaneously comparing the interactions of two players of a role and hobby war game. These interactions comprise elements of strategy, tactics or actions represented by an array. Each defined element of strategy, tactic or action is compared against all elements of an opponent's strategy, tactics or actions to produce a value that indicates how the combat resolution of the game is proceeding. Preferably, the interaction is modified by application of a special marker operative during a decision based combat resolution phase of the game in accordance with a defined set of rules.

Generally stated, the apparatus of the invention includes a game board comprising a geometric array. This geometric array is used to define the space around a game piece, character or unit in relation to the game piece, character or unit. Information about the formation, attitude of motion of the game piece is provided by the markers or graphic elements in accordance with a defined set of rules.

The present invention is advantageous for its lack of dependence upon the conventional use of dice or other random number generators in order to drive game play and force the players to make tactical decisions. This is advantageous because many important variables and scenarios occur during actual combat. Strategic and tactical decisions must be made in order to accommodate these situations and the inevitable outcome of decisions made and relied upon. In effect, there are a myriad of possibilities which the attacker or defender must prepare for. Each player, when assuming the position as either an attacker or defender, must react to the combat theater he or she finds himself thrust into. The player must also rely upon lessons learned from previous moves in order to determine the best course of action to attack or defend ones position. The combat resolution mechanism of the present invention accurately simulates mechanisms for addressing and resolving real combat scenarios. Game play is highly satisfying and much more proximate to actual combat resolution.

BRIEF DESCRIPTION OF THE DRAWINGS

The invention will be more fully understood and further advantages will become apparent when reference is had to the following detailed description and the accompanying drawings, in which:

FIG. 2 shows an event matrix;

FIG. 3 depicts a game sheet completed by a defender; and

FIG. 4 depicts a game sheet completed by an attacker.

DESCRIPTION OF THE PREFERRED EMBODIMENTS

Figure 1:
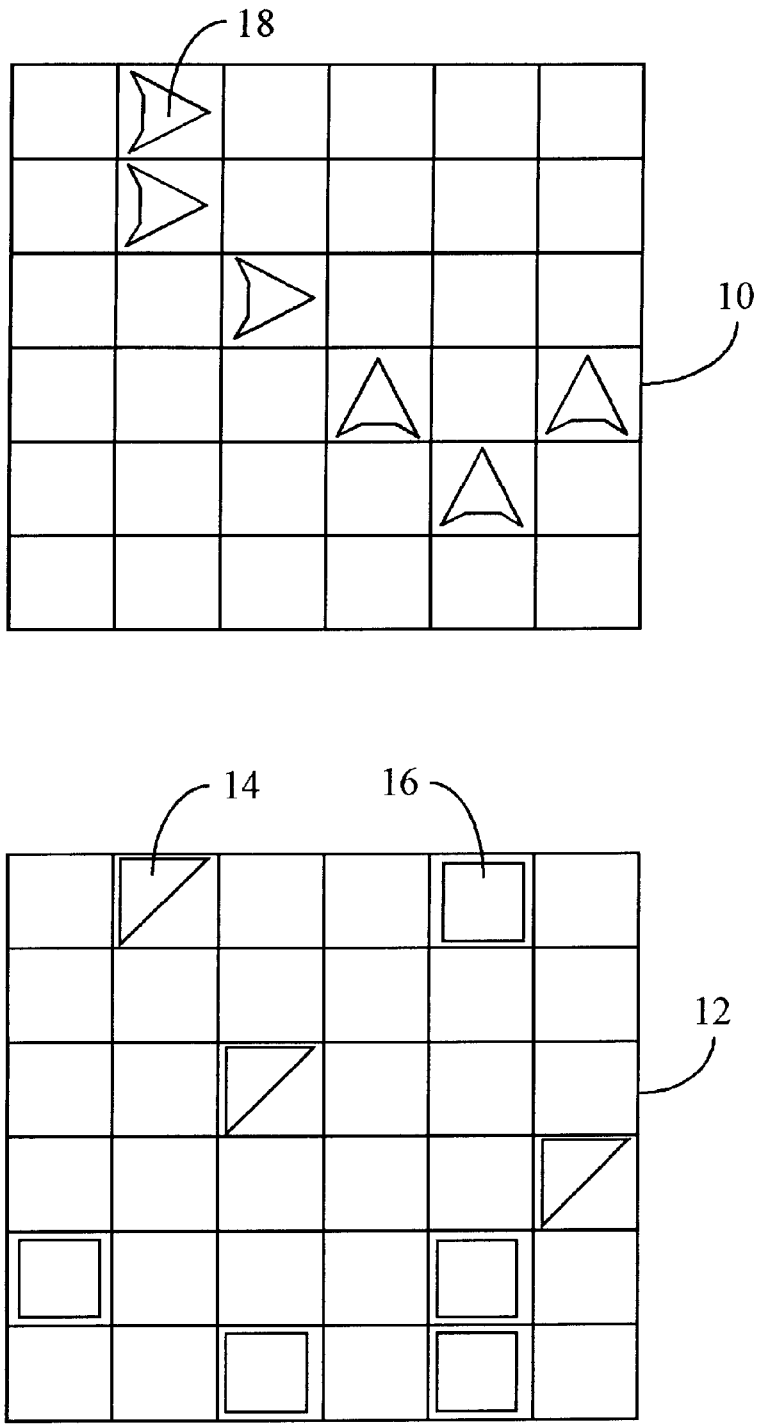
FIG. 1 depicts and attack conflict resolution board and a defense conflict resolution board with markers.

The present invention provides a method and apparatus for resolving combat and expanding war game play. Resolution of combat is accomplished without the use of dice or the like. Tactical decisions, not random number generation, become the driving force. In practice, during a strategy game conflicting armies of the players are disposed on a game board. An attacking player may move game pieces in conflict with a defending player. Traditionally, dice or random number generation has been used to determine the outcome of the conflict.

The present invention provides and apparatus and method for resolving individual conflicts during a game that is not based on chance generation of random numbers.

Briefly stated, there is provided in accordance with the invention, a method for defining a strategy, tactic or action of a game piece, character or unit. The strategy is defined by an arrangement of multiple graphical elements or markers. The graphical elements provide a player with options for creating strategies, tactics or actions to address a plurality of situations or scenarios.

In one embodiment, the method of the invention is accomplished by comparing the interactions of two players of a game. These interactions comprise elements of strategy, tactics or actions represented by an army. Each defined element of strategy, tactic or action is compared against all elements of an opponent's strategy, tactics or actions to produce a value that indicates how the combat resolution of the game is proceeding. Preferably, the interaction is modified by application of a special marker operative during a decision based combat resolution phase of the game in accordance with a defined set of rules.

Generally, the apparatus of the invention includes a game board comprising a geometric array. This geometric array is used to define the space around a game piece, character or unit in relation to the game piece, character or unit. Information about the formation, attitude of motion of the game piece is provided by the markers or graphic elements in accordance with a defined set of rules. Preferably, the apparatus for resolving a conflict in a strategy game comprises: (a) a conflict resolution board, the board comprising a geometric array; and (b) a plurality of markers, each of which represent a military unit. The markers are provided with graphics indicating the formation, attitude of motion of the unit in accordance with a defined set of rules; so that the outcome of the conflict is dependent upon the formation, attitude or motion of the military unit.

In a specific embodiment, conflicts are resolved during play of the strategy game by a method comprising the following steps: (a) the attacker secretly arranges markers on a first conflict resolution board; (b) the defender secretly arranges markers on a second conflict resolution board; (c) the players then identify regions of conflict on the first and second conflict resolution boards (which regions can be readily ascertained by locating areas defined by intersecting coordinates on the boards). An attacker's strategy is to anticipate regions where the defender's markers will be placed. The defender's strategy involves adding placement of markers in regions where markers of the attacker will be placed.

It will be understood by those skilled in the art that the defined set of game rules can vary depending upon the game being played. In such instances, it is important that the quantum of information provided by the game rule set convey sufficient information to enable a player to develop an appropriate appreciation of the formation, attitude or motion of each game piece based on the arrangement of markers or graphical elements.

As used herein, the term "game piece" means a figurine or other physical representation of a real object, such as a warrior, monster, war engine or weapons platform (i.e. a tank, artillery piece, vessel or aircraft) adapted to become a place marker on the battlescape, field of play or game surface.

The term "character", as used herein, means a non-physical representation of an actor in a free-form, role playing environment.

As used herein, the term "unit" represents platoons, companies, brigades, divisions, fleets, air-wings, squadrons, and the like that are represented by a counter on a game surface, board or map.

Referring to FIG. 1 of the drawings, the apparatus generally comprises first conflict resolution board 10 and second conflict resolution board 12, each having 6 columns and 6 rows. Appointed for placement on board 12 are the following: (i) a plurality of shield markers 14; (ii) a plurality of body markers 16; and (iii) a plurality of pincer markers 18. Items appointed for placement on board 12 are not limited to terms (i) to (iii), but comprise additional items, such as blank (or user defined) markers and the like. The apparatus further includes a attack strategy list, shown in Table I; a defense strategy list, also shown in Table I; and event matrix, shown in FIG. 2; a fire/melee chart, shown in Table II; and a damage resolution chart, shown in Table III. The values in these charts are not limited to these listed values. Use of different values would change the relative effect of the results; but would not change the scope thereof. Accordingly, such modifications are intended to fall within the scope of the invention. The first conflict resolution board is used by the attacker, while the second conflict resolution board is used by the defender; this allocation of the boards is applicable to each conflict involved in the game.

In the embodiment shown, the columns of the strategy board are defined by the numbers 1 through 6, and the rows are defined by the letters "A" through "F". The horizontal side of the apparatus closest to the player is known as the Rear; the side furthest from the player is known as the Front. Vertically running sides are marked appropriately Left and Right.

Preferably, markers are square and made of cardboard. However, it will be appreciated that they can be of any suitable material and shape. In an alternative embodiment, the markers are plastic disks. Preferably, the "body" markers are imprinted with a "square" symbol. The "shield" markers are imprinted with a "triangle" symbol. In this embodiment, the "pincer" markers are imprinted with an "arrowhead" symbol. Optionally, a further type of marker is blank, and its use is defined prospectively by the players.

TABLE I

Strategy Lists

| Attack Strategy | Defense Strategy |
|---|---|
| Charge Forward | Meet Attack |
| Slow Advance | Stand Firm |
| Flanking Attack Left; Right | Strengthen Left; Right Flank |
| Concentrate on Center | Concentrate Center |
| Infiltration | Defense in Depth |
| Encirclement | Disperse Defenders |
| Attack from Cover | Tactical Withdrawal |

TABLE II

Fire/Melee Chart

| Ratio | Marker Allocation offense | defense |
|---|---|---|
| 5.00:1+ | 15 | 15 |
| 4.00:1 | 14 | 14 |
| 3.00:1 | 12 | 14 |
| 2.50:1 | 12 | 12 |
| 2.25:1 | 10 | 11 |
| 2:1 | 10 | 10 |
| 1.75:1 | 10 | 8 |
| 1.50:1 | 9 | 8 |
| 1.00:1 | 9 | 7 |
| 0.75:1 | 8 | 7 |
| 0.50:1 | 8 | 6 |

TABLE III

Damage Resolution Chart

| | Delender | |
|---|---|---|
| Attacker | Relative Value | # of Markers |
| # of Strikes Recorded | 1.0 | 6 |
| | 0.9 | 7 |
| | 0.8 | 8 |
| | 0.7 | 9 |
| | 0.6 | 10 |
| | 0.5 | 11 |
| | 0.4 | 12 |
| | 0.3 | 13 |
| | 0.2 | 14 |
| | 0.1 | 15 |

Resolution of the results of a conflict between an attacker and a defender in the strategy game is accomplished by a method comprising the following steps. The relative strength ratio of the attacking force to the defending force is calculated using the predetermined rules of said game. An attacker secretly selects an attack strategy from a predetermined list of attack strategies. The attacker and the defender memorialize their selected strategies, which are thereafter revealed to one another. A determination is made regarding the intersection of the attack strategy and the defense strategy based on a predetermined event matrix. From the intersection there is selected the number of shields to be used by the defender that modify the combat resolution phase. A selection is also made as to marker allocation from a predetermined fire/melee chart, using the relative strength ratio. The attacker secretly arranges the attack marker allocation on a attack strategy board. At substantially the same time, the defender secretly arranges the defense marker allocation on a defense conflict resolution board. The attacker and the defender reveal the board arrangements of their markers to one another. A determination is then made concerning the number of strikes, as well as the number of damage resolution markers from a predetermined damage resolution chart. The number of strikes determines the number of rows and columns that the attacker will be permitted to designate during the damage resolution phase. Damage resolution markers are determined by the ratio of defensive attributes for the unit engaged versus the highest value of defensive attributes of any unit in the game. Thereafter, a defender secretly arranges the damage resolution markers on the defense conflict resolution board. The attacker selects a column and a row on said attack conflict resolution board. A determination is then made concerning the number of damage resolution markers on the selected column. The players next determine the number of damage resolution markers on the selected row. A determination is also made concerning the number of damage resolution markers on the selected row and column. Percent loss is then calculated from a predetermined formula relating the number of damage resolution markers on the selected column and rows. The defender is assessed with the percent loss for the conflict.

There are extant many different types of markers, as well as a large number of different orientations which the symbols can take. Accordingly, there is possible a large number of possible arrangements of the markers. The numerous marker arrangements permit each player to graphically represent a strategy. Such representations can mean a course of action as simple as advance, or retreat; or they can define a much more detailed action. Not infrequently, they represent more detail than conventional games allow.

The game is played by moving characters or units around a battlescape or imaginary environment, in a manner similar to that of some role playing games. During deployment, the units or characters move into an approximate position. A unit is explicitly positioned through use of the game board and markers, which define its exact formation. Once a formation or tactic has been chosen, the combat resolution phase commences. This phase is a one-turn, sub-game that allows the players to choose high or low risk gambits. Even though there is not present a random number generator, uncertainty is provided by the fact that both players are acting simultaneously throughout the sub-game. In addition, there exist an enormous number of gambits and specific arrangements among which the players may choose.

The method for resolving combat is essentially the same for each stage of the game. The difference is experienced after the combat resolution phase has been completed. The Combat Resolution Phase is a simple one stage sub-game, the objective of which is accomplished by the attacking player if he identifies the correct location of markers arranged by the defending player on his game board. An attacker does this by arranging markers on his game board. The overriding factor is this sub-game is the number of markers each player uses. Obviously, the more markers the attacking player has, the better becomes the chance that he will guess correctly. Conversely, increasing the number of markers a defender must arrange on his board lessens his chances. It thus follows that attackers with high combat ratings tend to use more markers than less powerful units. Likewise, strong defenders generally use less markers than weaker defenders.

The first step is to translate the combat ratings or strengths of the characters or units in the engagement into a proportion that will be related to a number of markers that each player will use. Therefore, a ratio is calculated for each engagement. All the pertinent factors are combined for both the attacking and defending players. The combined value of the attacking player is then divided by the combined value of the defending player. This works for both single and massed combat situations. The only difference is that in massed combat all the values of the units are combined together prior to calculating the ratio. This means that the result of the combat will be shared by multiple units. It is important to clarify what constitutes a single and massed combat. Single combat involves only two entities such as when two man 'o war vessels square off at sea. However if one side had two man 'o war vessels, a massed combat situation would be presented with respect to the two vessels, while the lone vessel would, of necessity, be involved in a single combat situation if it were attacking. These calculation produce a ratio such as 3.00:1 or 1.75:1, for example. Naturally, the ratio should be a number greater than one if there is to be any chance of success. The marker allocations are found on the Fire/Melee chart. These are for the 3.00:1 ratio, 12 markers for the attacking and 14 markers for defending. The 1.75:1 ratio is 10 for the attacker and 8 for the defender. It should be obvious that the more markers the attacker has the more likely he or she will be successful. Conversely, the defender having fewer markers is more likely to survive the combat.

In games where the combat rating is given as a value that must be met when rolling dice or using some other random number generator, another step must be included. These systems typically involve a probability of success. For instance, the rules may state than an attack is deemed so successful if the player rolls an 8 or less on a 20 sided dice. This equates to a probability of 0.4 which now becomes the relative offensive strength of the unit or character. If the situation was reversed, so that the player's attack would be successful as long as an 8 or less was not rolled, the probability would become 0.6 (12/20). Then the manner described above is applied to these probabilities.

The resolution sub-game has only one turn (or operation). The objective of this operation is simple, the attacking player will attempt to guess where the defending player will distribute a given number of markers (see Fire/Melee Charts) on his game Board. The attacking player does this in one of two ways. First, by blocking out a contiguous area on the attacking players board. Contiguous area, as defined herein, means a collection of body, markers placed in such a way that each marker makes contact with the corner or the side of at least tow other markers. If the defending player has any markers in the corresponding area they are counted as "strikes". A second method involves use by the attacking player of his arrow (pincer) markers to cordon off a corner of the game board. Because this is a much more efficient way of encompassing an area the attacking player is permitted to use no more than half the markers granted from either chart. The pincer markers will be pointed towards one corner only. Additionally, the attacking player is prohibited from placing these markers in the 4 corner squares of the game board. This prevents the player from cordoning off more than half the board. The defending markers that are in the partitioned area as well as in the squares occupied by pincers, are recorded as strikes.

The more strikes an attacking player registers, the more successful becomes his or her attack. This is true because of what will happen in the damage resolution phase. However, the defender has been granted a number of counter strikes depending on how the two players tactics match up on the event matrix. These counter strikes, as their name suggests, are used to cancel strikes made by the attacker. In order to do this, the counterstrike marker, represented by a shield symbol, must reside in the same position as one of the attacker's markers. Those counter strike shield markers that are simply within the spaced blocked out by the attacker's markers are simply not counted as strikes. If the defender has more counter strikes registered than the attacker has strikes, then the defender has won the engagement completely and the attacking player will be the one to receive casualties in the Damage Resolution Phase.

Strikes accumulated in the previous phase are next used to determine the condition the defender is left in. The defender distributes a given number of body symbols throughout his board, while the attacker chooses row and columns that equal the number of strikes he has accumulated (5 strikes=2 rows and 3 columns or vice a versa). The percentage of markers that are within the corresponding rows or columns chosen by the attacking player becomes the "quantum" of damage or casualties the defender has suffered.

These values are herein referred to as scores. Players should feel free however to make adjustments to scores as they see fit. For instance, players may want to make the number of initial scores needed to generate any damage dependent on the character or unit.

The number of markers used by the defender is determined by converting the characters defensive rating such as durability, armor, fighting Elan or all factors combined into a percentage of these attributes relative to the highest values of these attributes involved in the specific game. In other words if a character was half as durable as the most durable character in the game he would be granted twice as many markers to distribute as the most durable character. When units are made up of two or more different strengthened sub-units the attributes are averaged after being weighted.

In another embodiment, game sheets are used instead of a board, and markers are drawn on the game sheets instead of placing pre-made markers on the board. Advantageously, with this embodiment, the game sheets can be readily reproduced and kept for permanent record. FIG. 3 shows a game sheet that has been completed by the defender in an engagement. In FIG. 4, there is shown, a game sheet that has been completed by the attacker in an engagement. As illustrated by FIGS. 3 and 4, game sheets are divided into three parts: Command issuing Phase; Combat Resolution Phase; and Damage Resolution Phase.

Having thus described the invention in rather full detail, it will be understood that such detail need not be strictly adhered to but that various changes and modifications may suggest themselves to one skilled in the art, all falling within the scope of the present invention as defined by subjoined claims.

I claim:

1. A method for resolving the results of a conflict between an attacker and a defender in a strategy game, comprising the steps of:

a. calculating a relative strength ratio of an attacking force to a defending force using predetermined rules of said game;

b. said attacker secretly selects an attack strategy from a predetermined list of attack strategies;

c. said defender secretly selects a defensive strategy from a predetermined list of defense strategies;

d. said attacker and said defender reveal said selected strategies to one another;

e. determining the intersection of attack strategy and defense strategy from a predetermined event matrix;

f. selecting a number of shields from said intersection to be used by said defender;

g. select marker allocation of markers from a predetermined fire/melee chart using said relative strength ratio;

h. said attacker secretly arranging said marker allocation on an attack conflict resolution board;

i. said defender secretly arranging said marker allocation on a defense conflict resolution board;

j. said attacker and said defender revealing said arrangements to one another;

k. determining the number of strikes taken by said attacker and said defender against each other simultaneously;

l. determining a number of damage resolution markers from a predetermined damage resolution chart;

m. defender secretly arranging said damage resolution markers on said defense conflict resolution board;

n. attacker selects a column and row on said attack conflict resolution board;

o. determining simultaneously the number of said damage resolution markers on said selected row and column;

p. determining percent loss calculated from a predetermined formula relating the number of damage resolution markers on said selected column and rows; and q. assessing the defender with said percent loss for said conflict;

each of steps "a" through "q" being accomplished independent of random number generation.

* * * * *